US010722768B1

(12) United States Patent
Yi et al.

(10) Patent No.: US 10,722,768 B1
(45) Date of Patent: Jul. 28, 2020

(54) GOLF PUTTER HEAD AND PUTTER

(71) Applicant: Tat Wong, Kowloon (CN)

(72) Inventors: Fucheng Yi, Beiliu (CN); Guangfu Yi, Beiliu (CN)

(73) Assignee: Tat Wong, Kowloon (HK)

( * ) Notice: Subject to any disclaimer, the term of this patent is extended or adjusted under 35 U.S.C. 154(b) by 0 days.

(21) Appl. No.: 16/389,580

(22) Filed: Apr. 19, 2019

(51) Int. Cl.
*A63B 53/04* (2015.01)
*A63B 53/00* (2015.01)

(52) U.S. Cl.
CPC ..... *A63B 53/0487* (2013.01); *A63B 53/007* (2013.01); *A63B 2053/0416* (2013.01)

(58) Field of Classification Search
CPC ..... A63B 53/0487; A63B 53/007; A63B 2053/0416
USPC ..... 473/340
See application file for complete search history.

(56) References Cited

U.S. PATENT DOCUMENTS 4,872,683 A * 10/1989 Doran ..... A63B 53/04 473/249
5,766,093 A * 6/1998 Rohrer ..... A63B 53/0487 473/329
5,921,871 A * 7/1999 Fisher ..... A63B 53/04 473/329
6,089,993 A * 7/2000 Woodward ..... A63B 53/04 473/331
6,238,303 B1 * 5/2001 Fite ..... A63B 53/0487 473/342
2008/0108452 A1 * 5/2008 Chiang ..... A63B 53/0466 473/329

* cited by examiner

*Primary Examiner* — Michael D Dennis
(74) *Attorney, Agent, or Firm* — The Noblitt Group, PLLC

(57) ABSTRACT

The disclosure relates to a golf putter head and a golf putter including the putter head. The golf putter head comprises a putter head having a hitting face on which a hitting unit is distributed. The rigidity of the hitting unit is increased from the middle to both sides in the width direction of the hitting face. The golf putter comprises a putter shaft and a putter head coupled to putter shaft.

9 Claims, 4 Drawing Sheets

GOLF PUTTER HEAD AND PUTTER

CROSS-REFERENCES TO RELATED APPLICATIONS

This application claims the benefit of Chinese Patent Application No.

201910125613.0, filed Feb. 20, 2019, and incorporates the disclosure of the application by reference.

TECHNICAL FIELD

The present disclosure relates to golf equipment and, in particular, to a golf putter head and a putter.

BACKGROUND OF THE TECHNOLOGY

In golf, players first use wood and iron bars to hit the golf ball onto the green, and then commonly hit the golf ball toward the hole with a putter. A putted ball is affected by the smoothness of the green surface, soil moisture, grass mat thickness, grass species and so on. The golf ball typically also has a higher rolling speed on the green as compared to other portions of a golf course. Therefore, to smoothly put the golf ball into the hole as well as enjoying the play and winning the game, the putter must have better stability and higher fault tolerance to achieve precise ball control.

After testing the nine common putters sold in the market, it was found that the weight, the face technique and the hitting point of a putter head are working together to influence conversion rate. The inconsistency of the hitting point will result in different moving speed and moving distance. FIG. 1 is a schematic view of moving distance of a golf ball hit by a common type of golf putter. Referring to FIG. 1, under ideal situation, the middle section of hitting panel section hits a first golf ball 51, and then the first golf ball 51 moves a distance to reach a first stopping point 41. However, in the actual hitting, due to the performance of the player, if a second golf ball 52 or a third golf ball 53 is hit closer to either of the two sides of the hitting panel section 20 instead of a sweet point in a middle section, the second golf ball 52 or the third golf ball 53 changes in the moving direction and the moving distance compared with the first golf ball 51 and may eventually reach a second stopping point 42 or a third stopping point 43. Therefore, the fault tolerance is very small in the actual hitting.

Therefore, it is necessary to provide a golf putter head with higher fault tolerance and stability and a golf putter with the head.

SUMMARY OF THE TECHNOLOGY

An objective of the present disclosure is to provide a golf putter head with high fault tolerance and stability and a putter with the putter head.

According to the first aspect of the present disclosure, the disclosure provides a golf putter head which comprises a putter head, wherein a hitting face is provided on the putter head; a hitting unit is distributed on the hitting face, wherein the rigidity of the hitting unit is increased from a middle section outwardly to both sides along a width direction of the hitting face.

The hitting unit refers to protrusions, grooves or some other similar structures provided on the hitting face which are well known to those skilled in the art. In the meantime, a certain hitting unit can also form a certain texture on the hitting face and the hitting face is used to contact the golf ball. On the hitting face, the direction from the toe to the heel (or from the heel to toe) defines the direction of width of the hitting face, the rigidity of the portion of the hitting unit which is near the middle section of the hitting face is lower than the rigidity of the portion of the hitting unit which is far from the middle of the hitting face, and the different portions of the hitting unit or/and the hitting unit at different positions have a trend to gradually increase in rigidity from the middle to the both sides in the width direction of the hitting face. In addition, the rigidity distribution of the hitting unit can be specifically set according to the design of the golf putter head, the size and shape of the putter head, and the like. The end portion in the width direction of the hitting face (such as the toe portion and the heel portion) may be an area covered by the hitting unit, or may be an area not covered by the hitting unit. When the toe portion and the heel portion are areas that are not covered by the hitting unit, the rigidity of the toe portion is preferably higher than the rigidity of the hitting unit (or a portion thereof) which is near the toe portion. Similarly, the rigidity of the heel portion is preferably higher than the rigidity of the hitting unit (or a portion thereof) which is near the heel portion, which is, the rigidity of the hitting face is increased from the middle to both sides in the width direction of the hitting face.

According to the embodiment of the present disclosure, due to the difference in rigidity of the hitting face, when hitting the golf ball, the father away from the middle section of the hitting face, the larger momentum the golf ball achieved, the higher velocity the golf ball has, the less distance the golf ball loses during movement; the closer to the middle section of the hitting face, the greater distance the golf ball loses during movement. Since the difference in the moving distance of the golf ball after being hit by different portions is reduced, and the fault tolerance of the golf putter may be greatly improved, therefore the stability of putting may be improved.

Generally, a casing may be disposed on one side (e.g. the heel portion) of the putter head which can be coupled to the golf putter shaft to form a golf putter.

In addition, according to an embodiment of the present invention, the golf putter head may further have the following additional technical features:

- In some embodiments of the present disclosure, the hitting unit is disposed on panel connectors, and the panel connectors are fixedly coupled to the putter head.
- Advantageously, at least two panel connectors are sequentially coupled to the putter head.
- In some embodiments of the present disclosure, the hitting unit is arranged in an array on the hitting face.
- Advantageously, the hitting unit is arranged in an array of at least one of a linear array or an arc array.
- Advantageously, the array arrangement may be an array distributed along the width direction of the hitting face and perpendicular to each other. A single protrusion, depression or other structure of the array does not limit its size or specific shape, including but not limited to circles, triangles, rectangles, hexagons or other regular or irregular shapes.
- In some embodiments of the present disclosure, the hitting unit is made of at least one of an alloy or a plastic.
- Advantageously, the alloy is at least one of an iron alloy, an aluminum alloy, a copper alloy, or a titanium alloy.
- Advantageously, the iron alloy is at least one of 303 stainless steel, 304 stainless steel, 316 stainless steel, carbon steel S20C, carbon steel S25C, carbon steel S15C, carbon steel S45C, carbon steel 8620, or Carpenter steel.

Advantageously, the alloy is a heat treated alloy. Specifically, the heat treatment may be performed by solution treatment and then quenching to change the rigidity of the alloy.

The hitting unit has a trend to gradually increase in rigidity from the middle section outwardly to both sides (heel and tow portions) in the width direction of the hitting face, and the trend can be achieved by at least two ways, either alone or in combination. For example, in one embodiment, the first hitting unit made of different alloy materials with different rigidity is arranged on the hitting face in a certain rigidity order, wherein the rigidity increases from the middle to both sides (heel and toe portions); In a second embodiment, different heat treatment conditions may be applied to different portions of the hitting unit or the hitting unit to be disposed at different positions in order to achieve the rigidity gradually increasing from the middle to both sides (heel and toe portions).

According to a second aspect of the present disclosure, the disclosure provides a golf putter. The golf putter comprises a putter shaft and a putter head coupled to the putter shaft, wherein the putter head is the above-mentioned putter head. Specifically, the putter shaft can be coupled to the golf putter head by a casing provided on the golf putter head. Since the rigidity of the hitting unit is provided in a layer-wise manner, the difference in the moving distance of the golf ball after being hit by different portions is reduced, and the fault tolerance of the golf putter can be greatly improved, therefore the stability of putting can be improved.

BRIEF DESCRIPTION OF THE DRAWINGS

To describe the technical solutions in the embodiments of the present disclosure more clearly, the accompanying drawings to be used in the description of the embodiments will be briefly described below. The accompanying drawings described hereinafter are some of the embodiments of the present disclosure, and a person of ordinary skill in the art can acquire other accompanying drawings according to these accompanying drawings without any creative effort.

The present disclosure will be further described below by embodiments with reference to the accompanying drawings.

Elements and steps in the figures are illustrated for simplicity and clarity and have not necessarily been rendered according to any particular sequence. For example, steps that may be performed concurrently or in a different order are illustrated in the figures to help to improve understanding of embodiments of the present technology.

DETAILED DESCRIPTION OF EXEMPLARY EMBODIMENTS

The technical solutions in the embodiments of the present disclosure will be clearly and completely described as below with reference to the accompanying drawings in the embodiments of the present disclosure. Obviously, the described embodiments are only some but not all of the embodiments of the present disclosure. All other embodiments obtained by a person of ordinary skill in the art without any creative effort on the basis of the embodiments in the present disclosure shall fall into the protection scope of the present disclosure.

Figure 1:
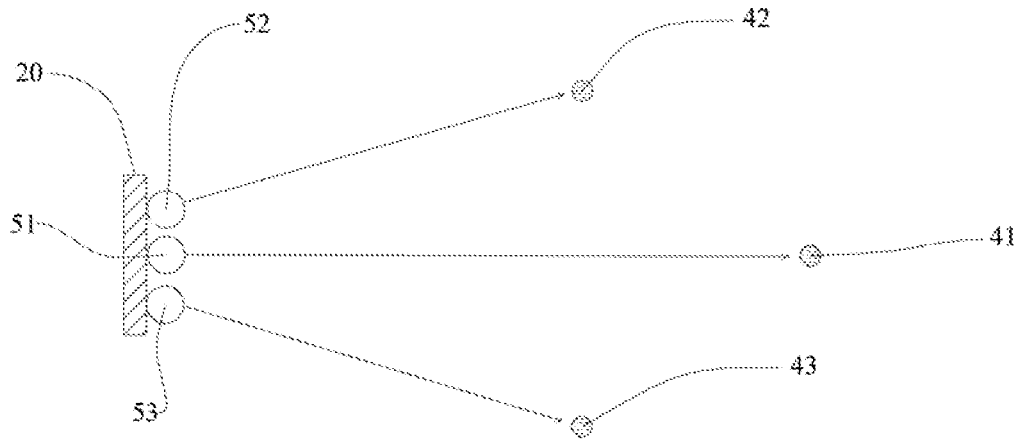
FIG. 1 is a schematic view of moving distance of a golf ball hit by a common type of golf putter.
Figure 2:
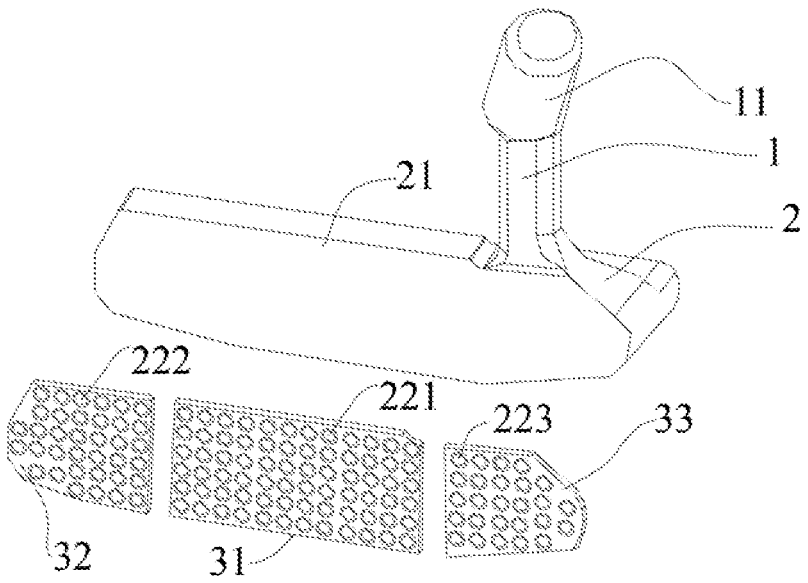
FIG. 2 is an exploded view of an embodiment of golf putter head according to the present disclosure.
Figure 3:
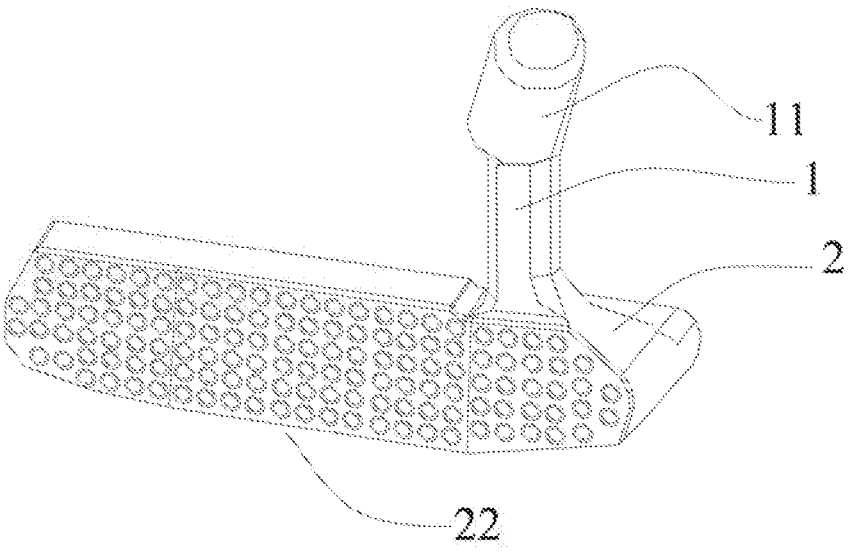
FIG. 3 is an overall schematic view of the golf putter head of the embodiment in FIG. 2 according to the present disclosure.

FIG. 2 is an exploded view of golf putter head of the embodiment and FIG. 3 is an overall schematic view of the golf putter head of the embodiment according to the present disclosure. Referring to FIG. 2 and FIG. 3, the golf putter head includes a putter shaft 1 and a putter head 2. A casing 11 is disposed at a first end of the putter shaft 1. The putter head 2 includes a hitting panel section 21, wherein the hitting panel section 21 is respectively fixedly coupled to a first panel connector 31, a second panel connector 32, and a third panel connector 33 by adhesives. The first panel connector 31 is provided with a plurality of rectangular arrays (6×12) to form a first hitting unit 221, the second panel connector 32 is provided with a second plurality of rectangular arrays to form a second hitting unit 222, and the third panel connector 32 is provided with a third plurality of rectangular arrays to form a third hitting unit 223. In one embodiment, the first hitting unit 221, the second hitting unit 222 and the third hitting unit 223 comprise circular protrusions having the same shape and size, but may be formed of different materials. For example, the first hitting unit 221 may be made of carbon steel S25C, and the second hitting unit 222 and the third hitting unit 223 may be made of carbon steel S45C.

The first panel connector 31, the second panel connector 32, the third panel connector 33, and the rest of the putter head 2 may be made of 304 stainless steel. The first hitting unit 221, the second hitting unit 222, and the third hitting unit 223 are welded to the corresponding first panel connector 31, second panel connector 32, and third panel connector 33. In the present embodiment, the first panel connector 31, the second panel connector 32, and the third panel connector 33 are fixed to completely cover the hitting panel section 21. Together, the first hitting unit 221, the second hitting unit 222, and the third hitting unit 223 form a hitting face 22.

A golf putter with relatively high stability and fault tolerance is obtained after fitting a suitable putter shaft with the casing.

Figure 4:
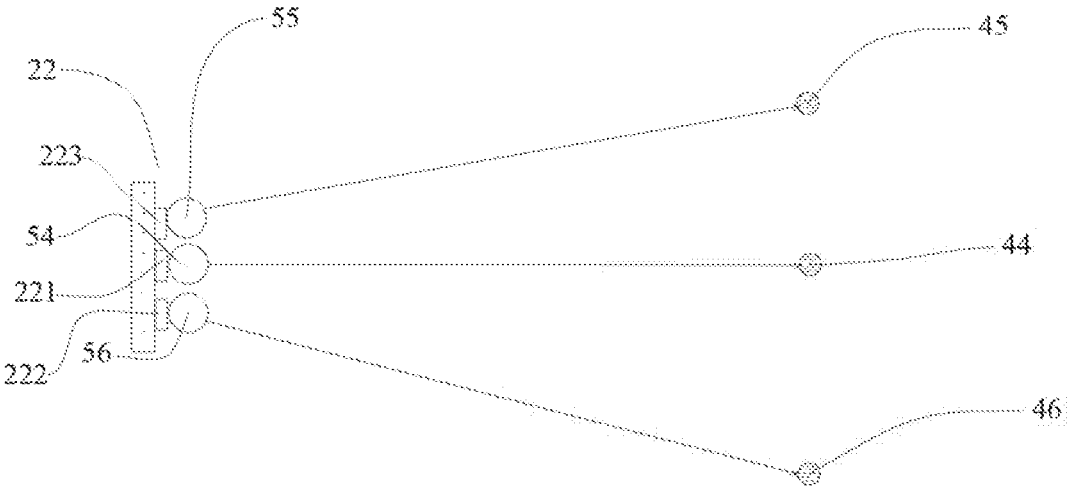
FIG. 4 is a schematic view of moving distance of a golf ball hit by the golf putter in an embodiment according to the present disclosure.

FIG. 4 is a schematic view of moving distance of a golf ball hit by the golf putter in an embodiment according to the present disclosure. Referring to FIG. 4, the first hitting unit 221 in the middle of the hitting face 22 hits a fourth golf ball 54, and then the fourth golf ball 54 moves a distance to reach a fourth stopping point 44. When the third hitting unit 223 or the second hitting unit 222 of the hitting face 22 hits a fifth golf ball 55 or a sixth golf ball 56, the fifth golf ball 55 or the sixth golf ball 56 changes in the moving direction and the moving distance compared with the fourth golf ball 54 and may eventually reach a fifth stopping point 45 or a sixth stopping point 46. After the first hitting unit 221 hits the golf ball, the moving distance loss of the ball becomes large, and after the second hitting unit 222 or the third hitting unit 223 hits the golf ball, the moving distance loss of the ball becomes small. After the golf ball is hit by different parts of the hitting face, the final moving distance of the golf ball descends discrete, which is, more similar moving distance is obtained by hitting with different parts, and the stability of the golf putter is improved.

Figure 5:
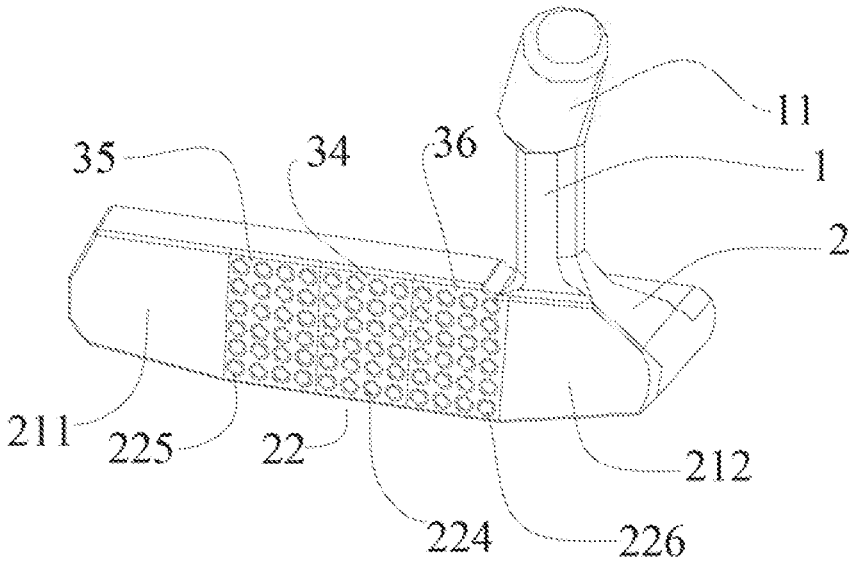
FIG. 5 is a structural schematic view of the golf putter head of a further embodiment according to the present disclosure.

FIG. 5 is a structural schematic view of the golf putter head of a further embodiment according to the present disclosure. Referring to FIG. 5, the golf putter head includes a putter shaft 1 and a putter head 2. A casing 11 is disposed at the heel portion of the putter shaft 1. The putter head 2 includes a hitting panel section 21, a mounting groove is disposed in the hitting panel section to embed a fourth panel connector 34, a fifth panel connector 35, and a sixth panel connector 36, both sides of the mounting groove are toe panel 211 and heel panel 212, the toe panel 211, the heel panel 212, the fourth hitting unit 224 of a plurality of rectangular arrays (6×3) on the fourth panel connector 34, the fifth hitting unit 225 of a plurality of rectangular arrays (6×3) on the fifth panel connector 35 and the sixth hitting unit 226 of a plurality of rectangular arrays (6×3) on the sixth panel connector 36 form the hitting face 22 together. The rigidity of the toe panel 211 is higher than the rigidity of the fifth hitting unit 225, and the rigidity of the heel panel 212 is higher than the rigidity of the sixth hitting unit 226. The fourth hitting unit 221, the fifth hitting unit 222 and the sixth hitting unit 223 are circular protrusions having the same shape and size, but different in materials; the fourth hitting unit 224 is made of brass H65M, and the fifth hitting unit 225 and the sixth hitting unit 226 are made of carbon steel S15C, the rest part of the putter head 2 (including toe panel 211 and heel panel 212) is made of carbon steel S25C.

Figure 6:
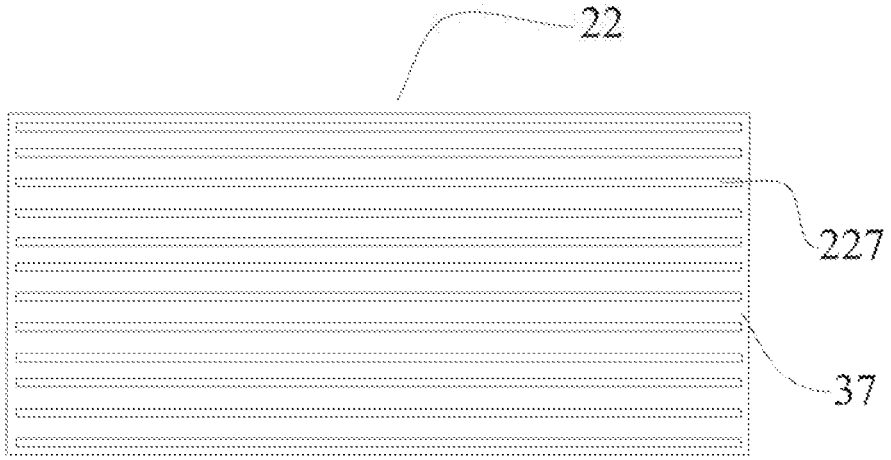
FIG. 6 is a schematic view of the putter head face of a further embodiment according to the present disclosure.

FIG. 6 is a schematic view of the putter head face of a further embodiment according to the present disclosure. Referring to FIG. 6, the hitting face 22 of the putter head of the present embodiment is composed of only a plurality of seventh hitting units 227, wherein the seventh hitting units 227 are disposed on a rectangular seventh panel connector 37 and are equally spaced in the vertical direction, and the seventh hitting unit 227 is a plurality of elongated protrusions extending in the width direction (horizontal direction) of the hitting face 22. The seventh panel connector 37 and the seventh hitting unit 227 thereon are forged and heat-treated by the following method: A 303 stainless steel bar is selected to perform rough forging, medium forging and fine forging at a high temperature of 800-1000° C. to obtain a seventh panel connector 37 and a seventh hitting unit 227 thereon. The temperature is raised to 1040° C. in a vacuum furnace for insulation treatment for 3 hours. After the temperature in the furnace is lowered to 300° C., the nitrogen is rapidly filled for cooling to normal temperature and then discharge. After the left and the right end are treated by high-frequency induction hardening at 1040° C. for 6 s, the 5-40° C. water is sprayed for rapid cooling for 5-30 s. The seventh panel connector 37 is then coupled to the hitting panel section by an adhesive.

Through the above steps, the rigidity of the hitting unit on the hitting face gradually increases from the middle section to both sides, and a golf putter head with a rigidity of around HRB100 on both sides is obtained.

Figure 7:
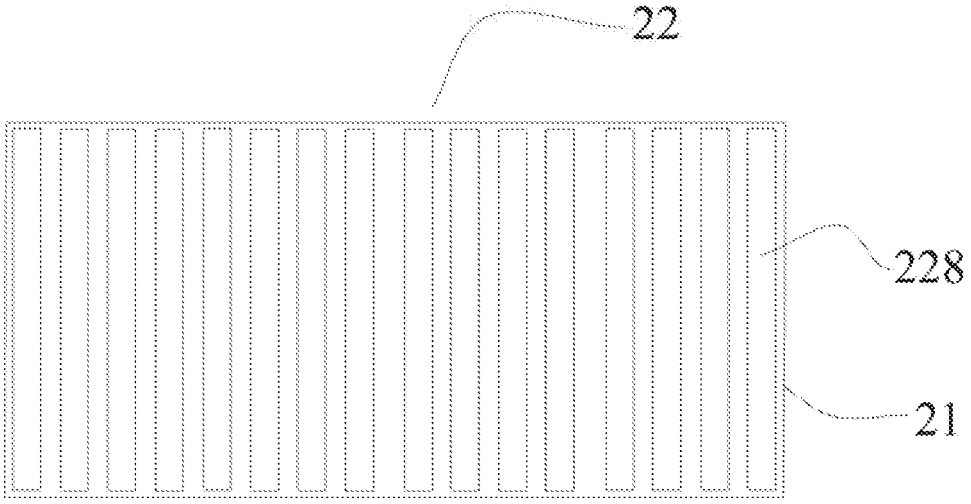
FIG. 7 is a schematic view of the putter head face of a further embodiment according to the present disclosure.

FIG. 7 is a schematic view of the putter head face of a further embodiment according to the present disclosure. Referring to FIG. 7, the difference from the above embodiment is that a plurality of alloy strips with different rigidity perpendicular to the width direction of the hitting face 22 are directly welded to the hitting panel section 21 as the eighth striking unit 228 to form the hitting face 22. The rigidity of the alloy strip (eighth hitting unit 228) is such that the rigidity of the alloy strip to the sides of the alloy strip is increased in a layer-wise manner.

Furthermore, a golf putter head which is different from the first embodiment since the material of the first hitting unit is plastic.

Although the preferred embodiments of the present disclosure have been specifically described by the above specific structures, the implementations and protection scope of the present disclosure are not limited thereto. Those skilled in the art can make various equivalent variations or replacements without departing from the principles of the present disclosure, and these equivalent variations or replacements shall fall into the scope defined by the appended claims of the present application.

These and other embodiments for methods of creating a putter may incorporate concepts, embodiments, and configurations as described above. The particular implementations shown and described are illustrative of the technology and its best mode and are not intended to otherwise limit the scope of the present technology in any way. Indeed, for the sake of brevity, conventional manufacturing, connection, preparation, and other functional aspects of the system may not be described in detail. Furthermore, the connecting lines shown in the various figures are intended to represent exemplary functional relationships and/or physical couplings between the various elements. Many alternative or additional functional relationships or physical connections may be present in a practical system.

The description and figures are to be regarded in an illustrative manner, rather than a restrictive one and all such modifications are intended to be included within the scope of the present technology. Accordingly, the scope of the technology should be determined by the generic embodiments described and their legal equivalents rather than by merely the specific examples described above. For example, the components and/or elements recited in any apparatus embodiment may be assembled or otherwise operationally configured in a variety of permutations to produce substantially the same result as the present technology and are accordingly not limited to the specific configuration recited in the specific examples.

As used herein, the terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present technology, in addition to those not specifically recited, may be varied or otherwise particularly adapted to specific environments, manufacturing specifications, design parameters or other operating requirements without departing from the general principles of the same.

The present technology has been described above with reference to exemplary embodiments. However, changes and modifications may be made to the exemplary embodiments without departing from the scope of the present technology. These and other changes or modifications are intended to be included within the scope of the present technology, as expressed in the following claims.

The invention claimed is:

1. A golf putter, comprising:

a putter shaft; and a putter head coupled to the putter shaft, wherein:

the putter head comprises a putter head having a hitting face with a plurality of panel connectors fixed thereon, wherein a first panel connector, a second panel connector, and a third panel connector are each welded with a first hitting unit, a second hitting unit, and a third hitting unit; and the first hitting unit, second hitting unit, and third hitting unit are formed as circular protrusions of different materials, in which the different materials are provided in a way that a rigidity of the hitting face is increased from a middle section to both sides in a width direction of the hitting face.

2. The golf putter of claim 1, wherein each hitting unit is disposed on at least one panel connector fixedly coupled to the putter head.

3. The golf putter of claim 1, wherein at least two panel connectors are sequentially coupled to the putter head.

4. The golf putter of claim 1, wherein the circular protrusions of each hitting unit is arranged in an array on the hitting face.

5. The golf putter of claim 1, wherein the circular protrusions of each hitting unit is arranged in an array of at least one of a linear array or an arc array.

6. The golf putter of claim 1, wherein each hitting unit is made of at least one of an alloy or a plastic.

7. The golf putter of claim 6, wherein the alloy is at least one of an iron alloy, an aluminum alloy, a copper alloy, or a titanium alloy.

8. The golf putter of claim 7, wherein the iron alloy is at least one of 303 stainless steel, 304 stainless steel, 316 stainless steel, carbon steel S20C, carbon steel S25C, carbon steel S15C, carbon steel S45C, carbon steel 8620, or Carpenter steel.

9. The golf putter of claim 6, wherein the alloy is a heat treated alloy.

* * * * *